United States Patent [19]

Lutz

[11] 4,208,307

[45] Jun. 17, 1980

[54] PURIFICATION OF COKE

[75] Inventor: Irvin H. Lutz, Sagamore Hills, Ohio

[73] Assignee: Arthur G. McKee & Company, Independence, Ohio

[21] Appl. No.: 945,586

[22] Filed: Sep. 25, 1978

[51] Int. Cl.[2] ..... H01B 1/04

[52] U.S. Cl. ..... 252/502; 201/17; 266/179

[58] Field of Search ..... 252/502; 201/17; 266/179

[56] References Cited

U.S. PATENT DOCUMENTS

| | | | |
|---|---|---|---|
| 3,184,037 | 5/1965 | Greaves et al. | 266/183 X |
| 3,460,818 | 8/1969 | Greaves et al. | 266/179 |
| 3,589,691 | 6/1971 | Greaves | 266/179 X |
| 3,756,791 | 9/1973 | Mancke | 201/17 X |
| 3,954,674 | 5/1976 | Reis | 252/502 |

*Primary Examiner*—E. Suzanne Parr

*Attorney, Agent, or Firm*—Bernard & Brown

[57] ABSTRACT

A process and apparatus are disclosed for purification of petroleum coke to produce an economical low sulfur product suitable for electrode production. Finely ground green coke is treated on an enclosed circular grate apparatus and subjected to sequential treatments in which hot gases are passed through a deep permeable bed of coke on the grate in a series of separate treating zones including a preheat zone, a heating and calcining zone, a desulfurizing zone in which hydrogen rich gas is passed through the heated bed, a reduction gas generation zone in which hydrocarbon and steam pass through hot coke to form hydrogen, and a cooling zone.

Adequate temperatures for calcination and desulfurization are achieved and the proper heating rate is obtained without overheating the metal parts of the hearth by use of radiant and hot gas heating means in the calcining zone and in the desulfurizing zone and by introducing the air and/or fuel gas near the bottom of the coke bed. Air is passed through the grate at a controlled rate to provide an oxygen deficient atmosphere during calcining, thereby avoiding unwanted coke combustion and high loss of coke fines due to combustion. The fines problem is solved by recycling flue gases through the coke bed which acts as a gas filter and by using sized coke free from fines on the top and bottom of the coke bed.

The circular grate apparatus is designed to provide a deep coke bed which results in greater efficiency and significant reductions in capital investment and operating costs, particularly for desulfurizing calcining which requires longer calcining times than ordinary calcining.

17 Claims, 8 Drawing Figures

PURIFICATION OF COKE

BACKGROUND OF THE INVENTION

Heretofore most petroleum coke had little commercial value because of an excessive sulfur content, which made it unacceptable for electrode production and undesirable for use as a fuel. At present the trend is to accept only those cokes having a sulfur content of 1.2 percent or less. Therefore, most petroleum cokes available today cannot be processed by normal calcination techniques to produce an acceptable electrode-grade coke.

For years, the major problem with oil refiners in disposing of petroleum has been the sulfur content of their petroleum coke. Refiners have spent large amounts trying to find a practical economical way of removing excess sulfur from their coke in order to make it commercially usable, but they were not successful. While various coke desulfurization methods were proposed, they did not provide adequate incentive for commercial development and did not provide a satisfactory solution to the problem.

Calcining of coke has also been a problem because of high cost. Rotary hearth calciners have been used for this purpose but have been uneconomical due to high capital investment and high operating expenses. The cost of calcining the coke in rotary kilns is increased because of inordinate loss of coke fines.

SUMMARY OF THE INVENTION

The present invention provides a solution to the above problems and makes possible economical treatment of petroleum coke to produce high quality electrode-grade coke of low sulfur content in a continuous process.

In the process of this invention, the green coke is fed to a traveling grate designed to facilitate gas flow through a thick permeable coke bed formed by the coke on the grate. The grate has means for passing gases through the coke bed in different zones to achieve the required sequence of heating, reaction and cooling. The thick coke bed used in the process insures good distribution of gas through the beds in the various zones and minimizes the cost of production.

Loss of fines in the process is minimized by passing all exhaust gases through a graded bed of coke on the grate, and loss of fines by combination is insignificant and can be virtually eliminated by operating all process stages in an oxygen deficient atmosphere.

In the preferred embodiment of the invention, the traveling grate is circular and has a charging location to receive green coke and a discharge location where desulfurized coke is removed. The portion of the grate between the charging and discharging locations is divided into treating zones including at least one preheat zone, a desulfurizing zone, and at least one cooling zone. A hydrogen gas generation zone is normally provided on the grate or in the coke accumulator for passing hydrocarbon and/or steam through the hot coke bed to produce a water gas ($CO+H_2$). The water gas may be increased in $H_2$ content by CO shift and $CO_2$ removal or used as generated. It is passed through the hot coke in the desulfurizing zone to remove sulfur, the latter zone being maintained under reducing conditions at a suitable high temperature, which may be in the range from 550° to 1400° C., depending upon the reactivity of the sulfur and other variables. Alternately, the required hydrogen containing gas may be supplied from an outside source.

In the preferred embodiment, radiant and hot gas heating are employed in both the calcining and desulfurizing zones. Radiant heat is provided by combustion heating means above the bed. The hot gas is supplied at the bottom of the grate to avoid overheating the metal parts by excessive combustion below the grate. The various treating zones through which the bed travels on the circular grate are preferably separated by transverse seals, and are sealed at the inner and outer circumference of the grate by liquid seals. The seals reduce heat losses and gas leakage between zones and facilitate control of the temperature and the pressure in each zone and more uniform coke treatment. Leakage through the seals is minimized by operating with small pressure differentials between adjacent zones. To prevent explosive mixtures and to reduce combustion of coke fines to a minimum, all zones are operated with an exygen-deficient atmosphere by careful control of air addition.

The coke is preferably preheated to a temperature of 150° to 300° C. in a drier before the coke is ground. Part of the larger sized coke is used to form a "filter bed" of coke with a substantial depth (e.g., 20 to 40 centimeters) above and below the finer coke as formed in the grinding step. Predrying of the larger coke particles is provided to avoid massive entrainment at the high gas velocities used. The preheat step also permits high heat recovery from off gas.

In order to achieve effective calcination and desulfurization of large amounts of the coke at minimum cost, it is important to employ green petroleum coke which is finely ground or which has small particle size (e.g., up to about 2 millimeters) and to operate with a coke bed which is relatively thick. Small particle size permits more rapid penetration of heat and treating gas to the interior of the particle and facilitates desulfurization. The green coke may, for example, be a finely ground petroleum coke containing 2 to 10 percent of sulfur and 4 to 18 percent of volatile matter.

The process of this invention makes it possible to use finely ground coke without a serious fines problem and avoids substantial loss of fine coke particles by combustion and entrainment in flue gases. A unique gas filtering system is employed in which layers of larger size coke particles or refractory material, substantially free of fines, are provided at the top and bottom of the coke bed and in which flue gases from one zone are collected and passed downwardly through the three-layer coke bed in another zone or in coke preheated to capture entrained fine particles.

In the calcining zone the radiant and hot gas heating provide rapid heating of the coke at the proper rate to a suitable calcining temperature. The content of volatile matter in the coke may be reduced by 90 to 99 percent or more in the calcining zone to less than 1 percent before coke reaches the desulfurizing zone. The aromatic tar recovered from the preheating zone may be used as binder in the subsequent processing step.

In the desulfurizing zone the water or other reducing gas has a hydrogen content high enough to achieve the desired degree of desulfurization at a suitable temperature, such as 600° to 1400° C., depending on the type of coke, the residence time and other variables.

Objects of the present invention are to provide a commercial process for continuous production of electrode-grade carbon from petroleum coke and to provide a simple traveling grate apparatus for carrying out the process in the most economical manner.

These and other objects, uses and advantages of the invention will become apparent to those skilled in the art from the following drawings, description and claims.

DESCRIPTION OF THE PREFERRED EMBODIMENTS

Figure 1:
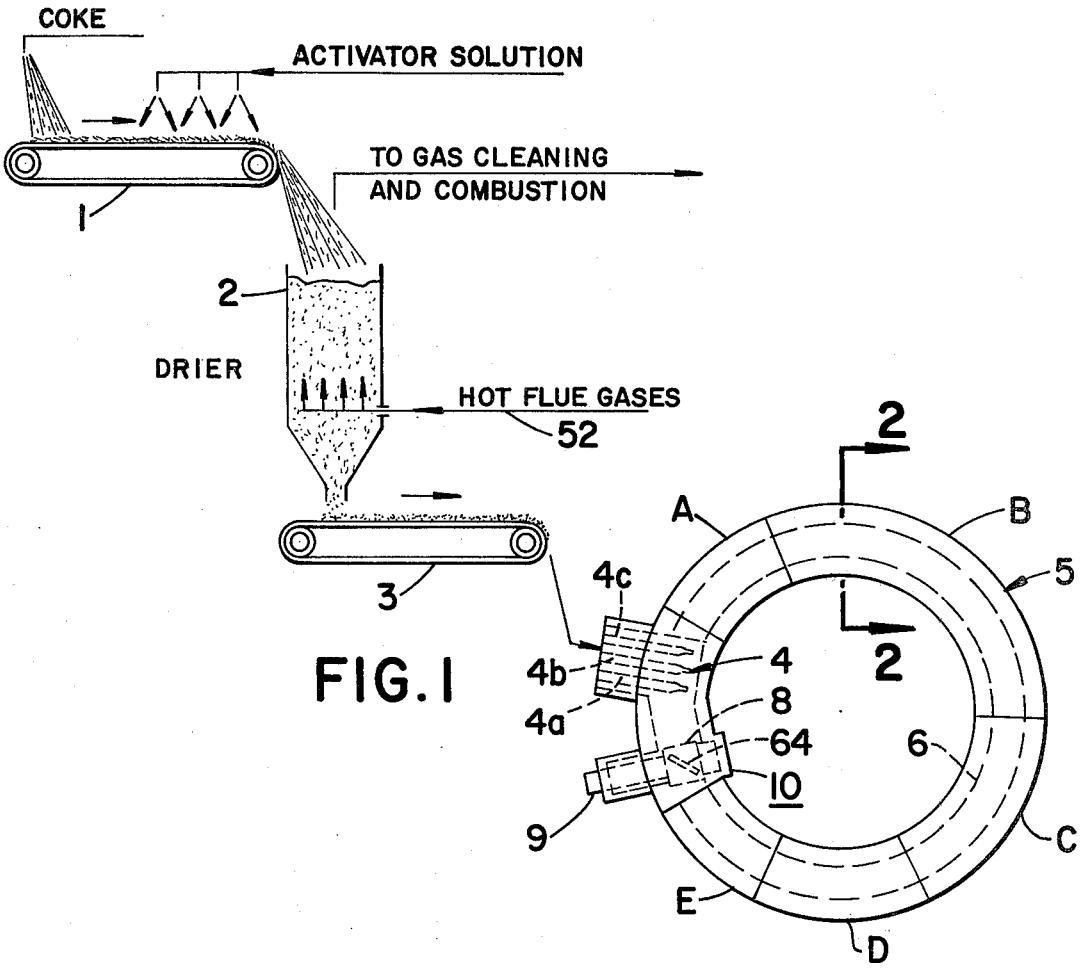
FIG. 1 is a diagrammatic plan view to a small scale of a preferred form of apparatus for calcination and desulfurization of coke according to the present invention.
Figure 2:
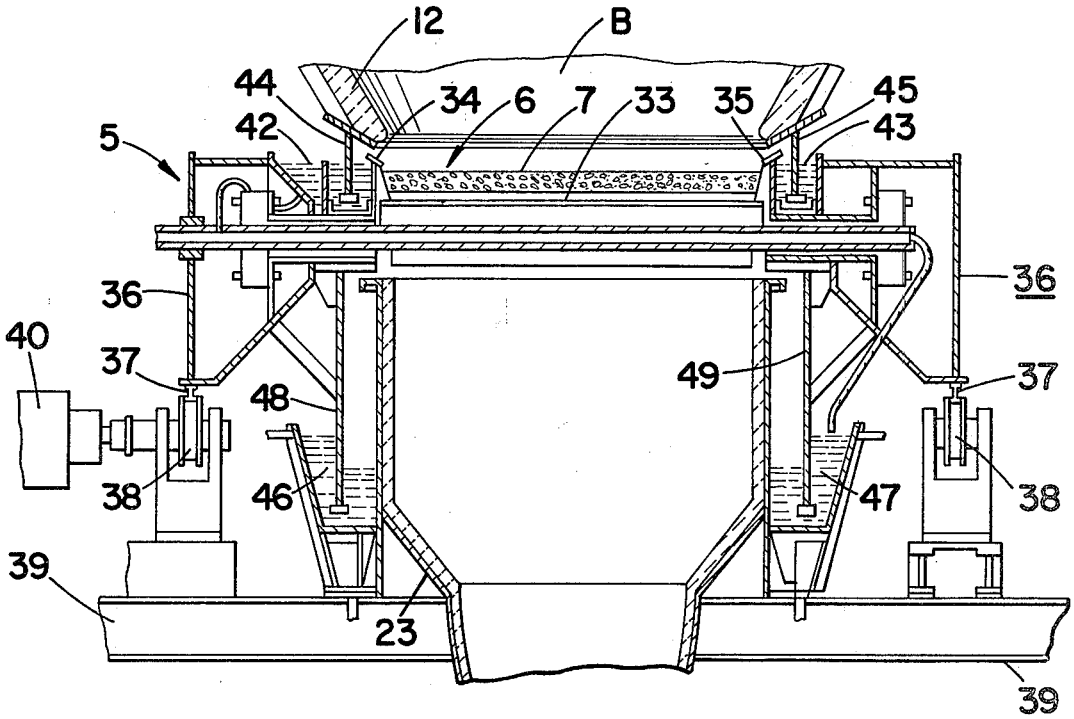
FIG. 2 is a fragmentary cross-sectional view taken along line 2—2 of FIG. 1 and to a larger scale showing a circular grate apparatus that may be used in carrying out the invention.
Figure 3:
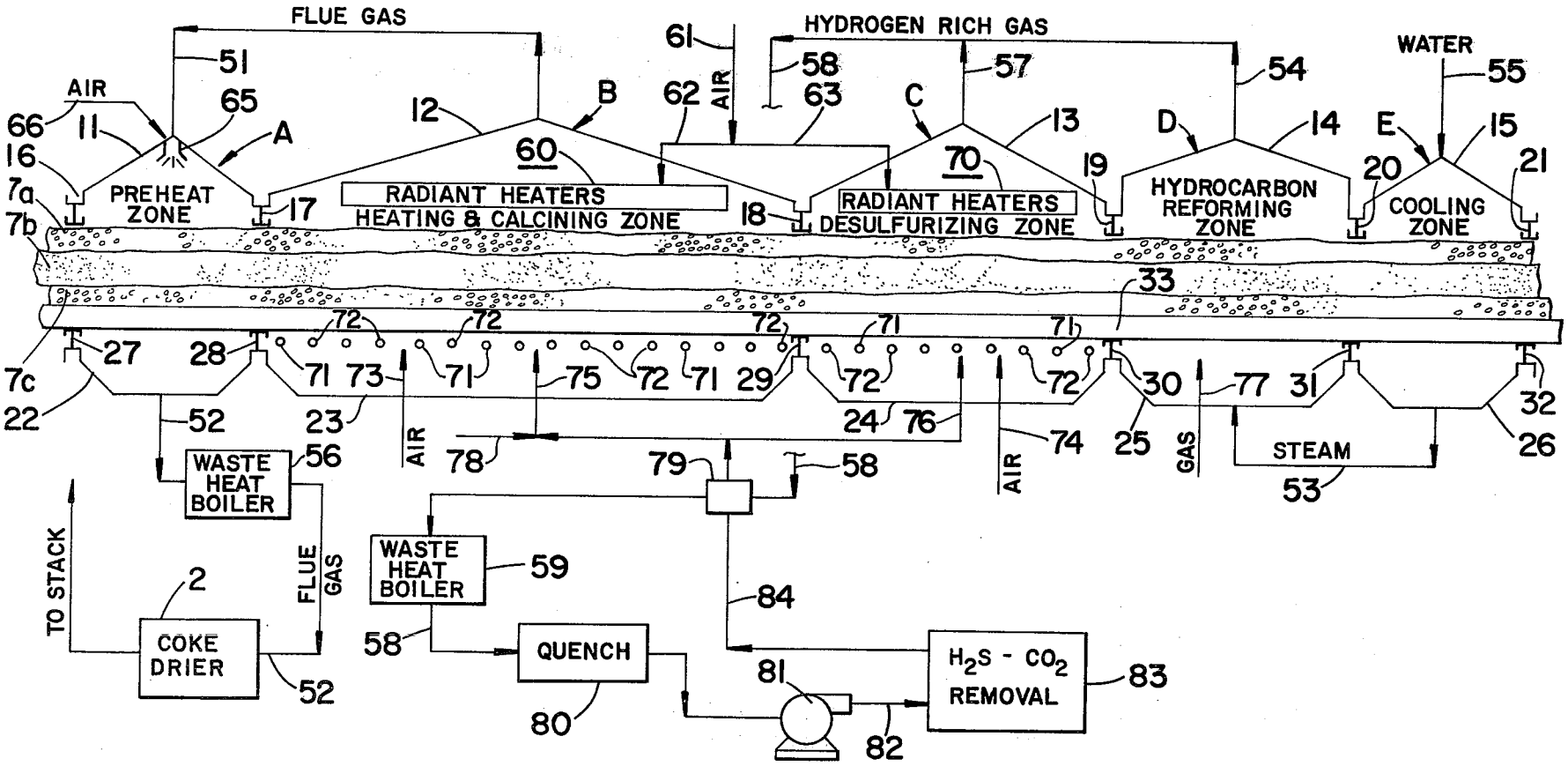
FIG. 3 is a diagrammatic extended side view of the circular grate portion of the apparatus of FIG. 1 but to a larger scale, diagrammatically illustrating the process of the invention and the equipment used with such circular grate portion.

Referring more particularly to the drawings, in which like parts are identified by the same numerals in the different views, FIGS. 1 to 3 illustrate one embodiment of the invention in which particles of green coke are fed onto a horizontal belt conveyor 1, optionally sprayed with an activator solution, and then discharged to a preheater-drier 2 where they are heated and dried by hot gases flowing upwardly through the drier. The exiting gases move to an exhaust stack or to gas cleaning and combustion equipment. The coke particles are dropped from the drier to a horizontal belt conveyor 3 and carried to known feed means 4 at the inlet of a circular grate apparatus 5, which may be similar to a known circular grate apparatus, such as disclosed in U.S. Pat. No. 3,460,818 or U.S. Pat. No. 3,589,691. The coke is fed to a traveling grate 6 and distributed in known manner by known means to form a bed 7 of substantially uniform depth on the grate as it rotates.

The coke bed is relatively deep and preferably consists of three superposed layers *7a, 7b* and *7c* as shown in FIG. 3. The upper and lower layers *7a* and *7c* preferably contain sized coke particles substantially free of very fine particles, and the main central layer contains coke particles as ground plus fine particles. The hearth layer *7c* may be formed of larger size coke particles or refractory particles which are continually recycled.

In the illustrated embodiment, the coke or refractory hearth layer is spread as required on the grate 6 by known feed means *4a*, and the other two coke layers are spread on the grate by known feed means *4b* and *4c*. Each of the feed means *4a, 4b* and *4c* may be of the type disclosed in the U.S. Pat. No. 3,184,037 comprising a belt conveyor having a reciprocating discharge end that moves radially across the width of the grate, the speed of reciprocation of the discharge end of the conveyor belt being related to its distance from the center of rotation of the grate to cause such belt to lay down a level bed of pieces on grate 6 as it moves. The feed means lays the three coke layers on the grate in such a manner that the moving bed 7 in which the coke pieces are at rest relative to each other has a generally uniform depth and is permeable to vertical gas flow in various process zones. The bed depth should be from 50 to 250 centimeters or more preferably 1 to 2 meters.

The traveling grate apparatus of FIGS. 1 to 7 preferably has a grate 6 that is circular in plan and travels in a circular path to carry the coke bed 7 through five process zones A, B, C, D and E (FIGS. 1 and 3) in which the coke is subjected to the treatment described later. The relative movement between the coke bed and the various process zones is preferably provided by rotation of the grate, but such relative movement may be provided in other embodiments of the invention in which the grate itself remains stationary and rotation is simulated by changing the gas flow composition to the various zones.

In the illustrated embodiment, the grate rotates to carry the coke from the charging location at 4 to a discharge location where the desulfurized coke is removed from the grate by known discharge means 8 and deposited on known conveyor means 9 for removal to another location. The discharge means 8 may be a conventional scraper or may have scoops or buckets to lift the coke from the grate as disclosed in U.S. Pat. No. 3,460,818. Also the discharge means may cause the coke to drop through the grate if the grate has tiltable hearth segments as disclosed in said patent.

Both the feed means 4 and the discharge means 8 in the illustrated embodiment are enclosed in gas tight enclosure means 10 which may be provided with known gas lock means, not shown, at the location where the infeed conveyor enters the enclosure means and at the location where conveyor means 9 discharges the desulfurized coke from the enclosure means.

The circular grate apparatus 5, illustrated diagrammatically in FIG. 3, comprises stationary hoods 11 through 15 respectively located above the grate at treating zones A through E and having end and intermediate transverse seal portions 16 through 21. Stationary lower gas enclosures 22 through 26 respectively associated with hoods 11 to 15 in zones A to E are provided under the grate and have end and intermediate seal portions 27 through 32, which may, for example, be of the type shown in the aforesaid U.S. Pat. No. 3,589,691.

As shown, grate 6 has a known gas-permeable refractory hearth 33 which supports the coke bed 7 and permits gas flow through the grate and has upstanding side walls 34 and 35 extending around the outer and inner circumferences of the grate. The grate is supported by a rigid annular frame 36 rotatable about a fixed vertical axis. Frame 36 carries concentric circular rails 37 which are supported by rollers 38 supported from rigid frame 39 and driven by power means 40.

Traveling grate apparatus 5 includes means for preventing gas leakage. Suitable transverse sealing means at the end and intermediate seal portions above and below the grate reduce unwanted flow of gases. Hoods 11 and 15 and end closures 22 and 26 are connected gas tight to enclosure means 10, which encloses feed means 4 and discharge means 8.

The side sealing means illustrated is similar to that described in U.S. Pat. Nos. 3,460,818 and 3,589,691. To seal grate 6 to the hoods above the grate, annular channel-shaped troughs 42 and 43 (FIG. 2), containing water or other suitable liquid at a suitable maintained level, are fixed in gas-tight relation to the grate 6 adjacent the outer and inner walls of the grate and carried by the rigid frame 36. Shield walls 44 and 45 extend downwardly into the liquid in troughs 42 and 43. These walls preferably extend continuously throughout the lengths of all the hoods, their intermediate portions preferably being connected at the ends of the hoods to transverse baffle members in the troughs that prevent escape of gas.

Stationary liquid-containing troughs 46 and 47 are provided below the traveling grate in gas-tight relation to inner and outer walls of gas enclosure 22 to 26 and their intermediate portions, and extend around the apparatus. Shield walls 48 and 49, fixed in gas-tight relation to the bottoms of upper troughs 42 and 43 and hence to side walls of grate 6, have their lower ends immersed in liquid in associated troughs 46 and 47.

Therefore, as traveling grate 6 moves about its axis in a circular path, upper troughs 42 and 43 travel with it while upper shield walls 44 and 45 remain stationary and by projection into the liquid effectively seal the sides of the hoods against escape of hot gas or ingress of ambient air; and inner shield walls 48 and 49 travel with the grate and extend into the liquid in lower troughs 46 and 47 and seal the sides of lower enclosures below the grate against escape of gases or ingress of air.

The drawings are schematic and not necessarily to scale. As shown in FIG. 2, the grate 6 is horizontal, but it will be apparent that it may be sloped to facilitate solids removal and may be of substantially different size or substantially greater width. Also the coke bed may be deeper than illustrated and the hearth may be of a substantially different type.

The preferred embodiment of the invention employs a circular grate apparatus as in FIG. 3, which is an expanded view with certain structural parts omitted. As shown, the portion of the circular grate between the charging location at 4 and the discharge location at 9 is divided into five zones A through E. The hood 11 and associated lower gas enclosure 22 define preheat zone A in which particles of green coke on the grate are first subjected to preheating by hot flue gas passing from conduit 51 down through bed 7 to conduit 52. The latter conduit conducts the waste gases to the coke drier and heater 2 as shown in FIG. 1.

The next hood 12 and lower gas enclosure 23 define heating and calcining zone B in which combustion is supported by air and fuel gas supplied thereto as described hereinafter, the hot gases passing upward through the bed and exiting hood 12 through conduit 51.

The next hood 13 and its associated lower gas enclosure 24 define a desulfurization zone C in which the hydrogen-rich gas generated in zone D passes updraft through the hot bed 7 to hydrodesulfurize and further calcine the coke. Radiant heating means 70 described hereinafter are provided to help maintain a temperature in zone C suitable for desulfurization, such as 550° to 1400° C., depending on coke composition and residence time.

The next hood 14 and its associated lower gas enclosure 25 define a hydrocarbon reforming zone D in which the hot desulfurized coke from zone C contacts hydrocarbon gas and steam. The steam supplied from conduit 53 reacts with the hydrocarbon gas as it passes updraft through the hot coke bed to the conduit 54. The coke is partially cooled by transferring heat to the reacting gases, and very little of the coke reacts. The primary reaction, assuming methane is used as the hydrocarbon feed, is as follows:

$$CH_4+H_2O \rightarrow CO+3H_2$$

It is preferable to cool the coke leaving zone D before it is removed from the grate. As herein shown, the hood 15 and its associated lower gas enclosure 26 define a cooling zone E which receives water from conduit 55 and discharges steam to conduit 53.

Cooling of the coke leaving zone D or zone E may also be effected by passing air through the coke bed, in which case the preheated air may be used to preheat the coke bed before it enters zone A.

Various means may be employed to minimize heat losses. As shown the hot flue gas from the calcining zone B passes through conduit 51 to preheat zone A, then through conduit 52 to a waste heat boiler 56 and to the preheater-drier 2 (FIG. 1), and finally to the stack at a reduced temperature, such as 110° to 200° C.

Part of the heat in the hydrogen-rich gases leaving the zones C and D through conduits 54 and 57 can also be recovered by passing means or all of such gases through conduit 58 to a waste-heat boiler 59.

FIG. 1 illustrates diagrammatically how the coke may be treated and preheated before it enters the traveling grate apparatus 5. The use of an activator or catalyst spray is optional. The preheating is important because it reduces heat requirements and the time required to bring the coke to the desired clacining temperature. As shown the hot flue gases from the preheat zone A pass through conduit 52 to preheater-drier 2, which may be a vertical tubular vessel or the like.

The coke bed must be heated to high temperatures to effect the desired calcination and desulfurization in zones B and C, and it is important to avoid excessive metal temperatures. The grate may be cooled by air and/or steam passing through support tubes or the like, and overheating of the grate is avoided in several ways. In accordance with the invention, low metal temperatures are maintained at the bottom of the bed while at the same time providing controlled high coke temperatures by causing a hydrogen-rich gas or fuel gas to move upwardly through the bed, by mixing the gas with air at or near the bottom of the bed, and by partially burning the gas in the space above the grate segments to produce a very hot reducing gas, which in passing upwardly through the coke heats it to the required temperature without substantial combustion of fine coke particles.

The unburned gas leaving the bed is partially burned in radiant heaters located above the bed to provide heating from above. The radiant heaters are supplied with additional air to support combustion and need not be supplied with additional fuel. The radiant heating helps minimize temperature variation through the bed and provides high coke temperatures without overheating the grate.

With the radiant heating and controlled burning in the coke bed above the grate, the lower portions of the grate and associated support tubes are not in contact with coke above 550° F. as they move from zone A to zone E of the circular grate apparatus, and there is no overheating of the metal parts of the grate.

The radiant heating means for the zones B and C may be generally the same. As shown herein, each of the radiant heating means 60 and 70 in hoods 12 and 13 is a combustion heater receiving air from supply conduit 61. Heater 60 receives air through branch conduit 62 and heater 70 through branch conduit 63. The fuel for each heater is the unburned gas rising from the coke bed.

An important feature of the invention is the control of the calcining zone B and the desulfurizing zone C to provide an oxygen-deficient atmosphere and to avoid unwanted burning of the coke, particularly the fine coke particles.

Another important feature is recapture of entrained coke fines in the flue gas by passing the flue gas downwardly through a graded coke bed and using the bed as a filter. As shown schematically in FIG. 3, the hot flue gas from the calcining zone B, which contains some unburned fuel gas and some coke fines, passes through conduit 51 to a burner 65 at the top of the hood 11 of the preheat zone A which receives air through conduit 66. Combustion is completed in zone A and the flue gas passes downwardly through the bed to preheat the coke while depositing the coke fines that were entrained therein.

In the coke bed 7 the upper and lower layers *7a* and *7c* consist of sized coke substantially free of fine particles and having a particle size preferably no greater than 3 millimeters and more preferably in the range of 1 to 2 millimeters. If desired, the sized coke can be much coarser than the coke of the main central layer *7b*. The latter usually contains substantial amounts (e.g., at least 20 percent by weight) of fine coke particles with a particle size less than 0.5 millimeter. Each of the layers *7a* and *7c* preferably has a depth of more than 15 centimeters and preferably 20 to 40 centimeters with a thick coke bed. If desired, the hearth layer *7c* can be formed of refractory particles rather than coke and can be repeatedly recycled.

The hearth 33 of the grate 6 is made up of a large number of segments 67 having openings to permit gas flow but small enough to prevent the coke of refractory particles of layer *7c* from dropping out. The hearth segments are mounted on hollow tubular supports 68 and 69 which may carry a cooling fluid, such as steam. The segments may be mounted to tilt at the discharge location to discharge the calcined coke in known manner, as for example, U.S. Pat. No. 3,460,818 and 3,589,691, but tilting is not necessary if other means, such as discharge means 8, are employed to remove the coke from the grate. Good results are obtained, for example, when using an inclined scraper 64 above the discharge conveyor 9 as shown in FIG. 1 to discharge the coke from the grate.

In the preferred circular grate apparatus of the present invention, the air and/or fuel gas is introduced at the hearth or at the bottom of the coke bed. FIG. 3 shows diagrammatically a large number of fixed horizontal transverse supply tubes 71 and 72 spaced along the length of zones B and zone C for discharging air and gas through the coke bed. As shown, each supply tube 71 is adjacent to and located between two tubes 72, but other arrangements can be employed. In FIG. 3 the diagrammatic arrows at conduits 73 and 74 indicate generally the supply of air below the coke bed, and the arrows at conduits 75, 76 and 77 indicate generally the supply of fuel gas or reducing gas to the coke bed at zones B, C and D. It will be understood that such air or gas can be introduced directly to the bed through discharge openings in the support tubes 71 and 72 as described hereinafter.

Figure 8:
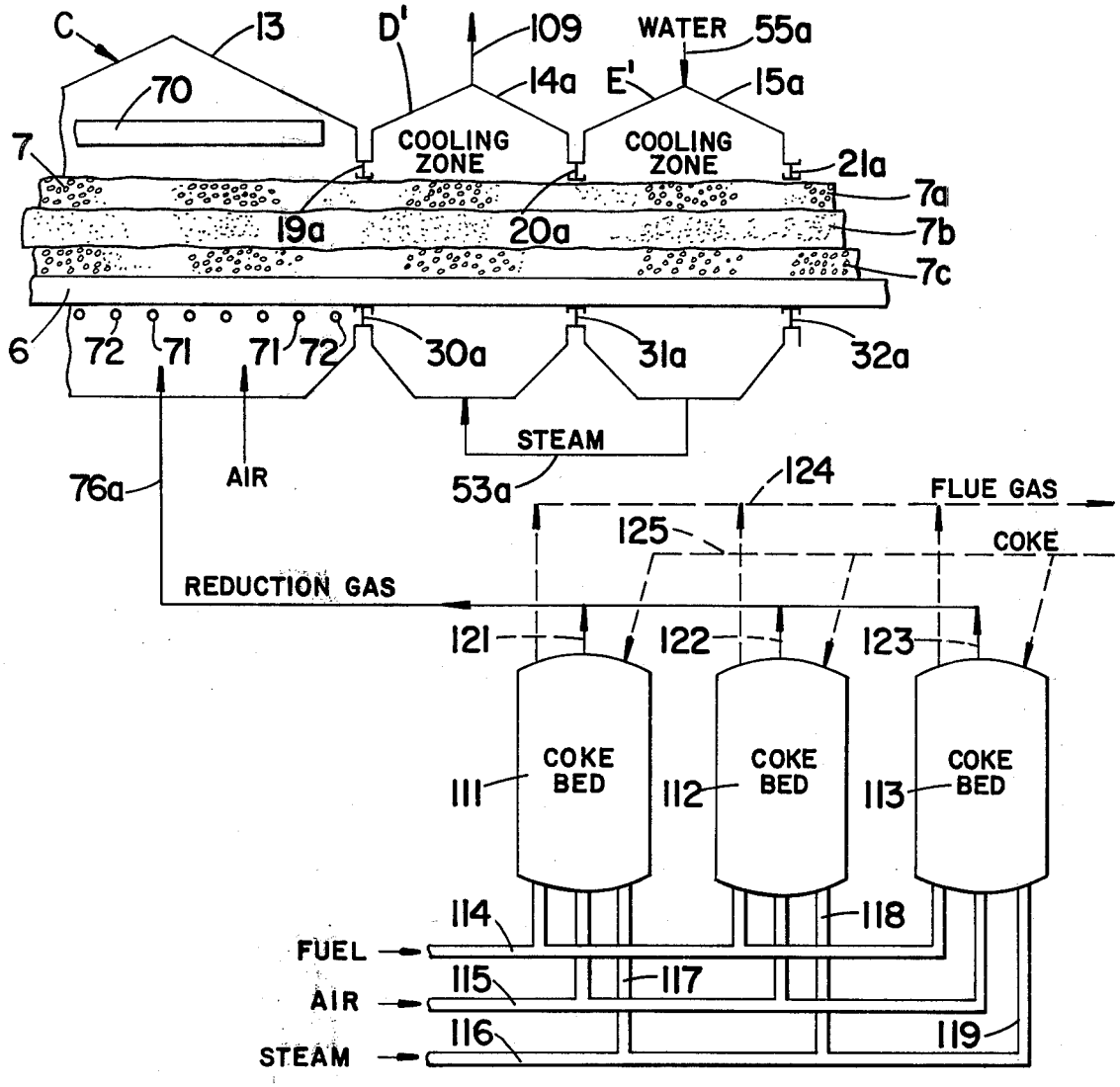
FIG. 8 is a diagrammatic elevational view to a small scale showing an alternative form of apparatus for carrying out the invention including an extended side view of another circular grate apparatus and the equipment used therewith.

In the preferred embodiment the hydrogen-rich fuel gas required for zones B and C is water gas made by passing steam and methane or other hydrocarbon gas through the hot coke bed in zone D. The gas leaving zone D through conduit 54 is preferably mixed with hydrogen-rich gas from desulfurization zone C, which contains hydrogen sulfide gas. As shown in FIG. 3, the hydrogen-rich gas from zones C and D is collected in conduit 58 and passes through heat-exchanger 79 where it is cooled before it enters waste heat boiler 59. Thereafter gas from conduit 58 is further cooled in quench unit 80 and then carried by pump 81 to conventional sulfide-removal unit 83 where hydrogen sulfide and carbon dioxide are removed from the gas. The cool hydrogen-rich gas then passes through conduit 84 to heat-exchanger 79 where it picks up heat from the hot gas of conduit 58 before entering conduits 75 and 76. Most or substantially all of the fuel gas required for operation of the equipment can be made in hydrogen reforming zone D. If more fuel gas is desired it can be supplied from an outside source. A coke oven gas or producer gas might be used. The fuel gas or producer gas may also be produced externally as shown in FIG. 8. As shown in FIG. 3, the additional fuel gas is admitted through conduit 78 to conduit 75 of the calcining zone B, which conduit may supply the burner tubes 72, for example.

In the embodiment of FIG. 3, the hydrocarbon reforming zone is located on the rotating grate apparatus, but it will be understood that it can also be located externally in a coke accumulator which receives hot desulfurized coke discharged from the grate.

An important advantage of the circular grate apparatus of this invention is the ability to function safely and efficiently without expensive transverse seals between zones and with leakage from one zone to the next. Relatively simple transverse seals are adequate which restrict or limit the flow of gases from one zone to the next, and many different types of seals can be used. Details of the seals form no part of this invention.

Figure 4:
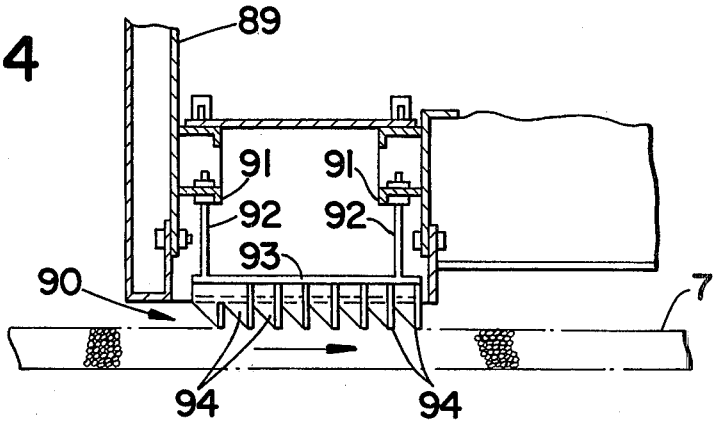
FIG. 4 is a fragmentary sectional elevation to a small scale showing a form of transverse sealing means that may be used above the grate at the entrance to the first treating zone of the circular grate apparatus.

Although transverse sealing means are not essential, it is often desirable to provide such means, and examples of suitable seals are illustrated in FIGS. 4 to 7. FIG. 4 illustrates sealing means 90 which may be used above the grate at the sealing portions 16 and 21 of the gas enclosure hoods 11 and 15. Sealing means 90 is shown located at front wall 89 of hood 11 and supported at cross members 91 fixed to the hood and extending substantially across the grate. Vertically adjustable supporting rods 92 depending from the cross members support transverse sections of the sealing means, each section having a top plate 93 carrying a series of downwardly depending baffle vanes 94 that closely approach the top of the coke bed 7 moving thereunder. The baffle vanes can extend horizontally substantially across the hearth and present a tortuous path for the gases.

Figure 5:
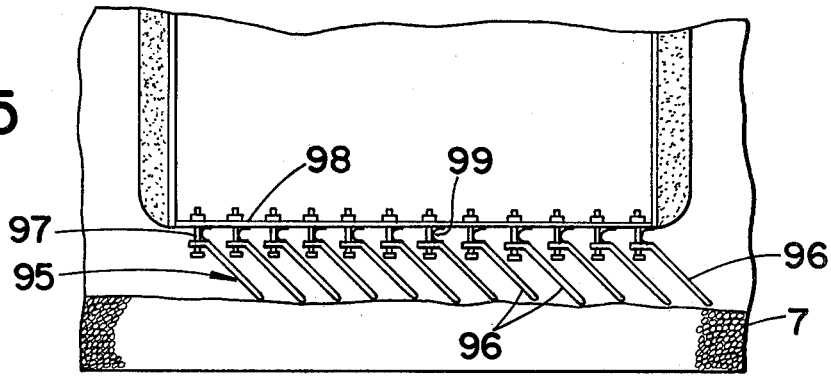
FIG. 5 is a fragmentary sectional elevation to a small scale showing another form of transverse sealing means that may be used above the grate and the bed thereon between two adjacent treating zones.
Figure 6:
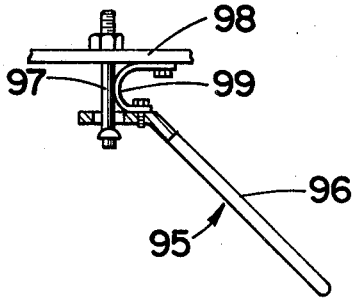
FIG. 6 is a fragmentary detail of one of the sealing elements of FIG. 5 but to a larger scale.

FIGS. 5 and 6 illustrates schematically one type of sealing means 95 which may be used at the top of the bed between adjacent hoods at the sealing portions 17 through 20. The sealing means 95 comprises flexibility mounted sheet metal vanes 96, each extending the full distance across the width of grate 6 between its side walls. The upper portions of these vanes are pivotally supported on upwardly extending members, such as bolts 97 carried by horizontal beam 98. The vanes 96 have lower edges which can lightly engage the top of the moving coke bed 7. The sealing means 95 preferably has flexible heat-resistant sheets 99 to close the spaces between beam 98 and the vanes 96.

Figure 7:
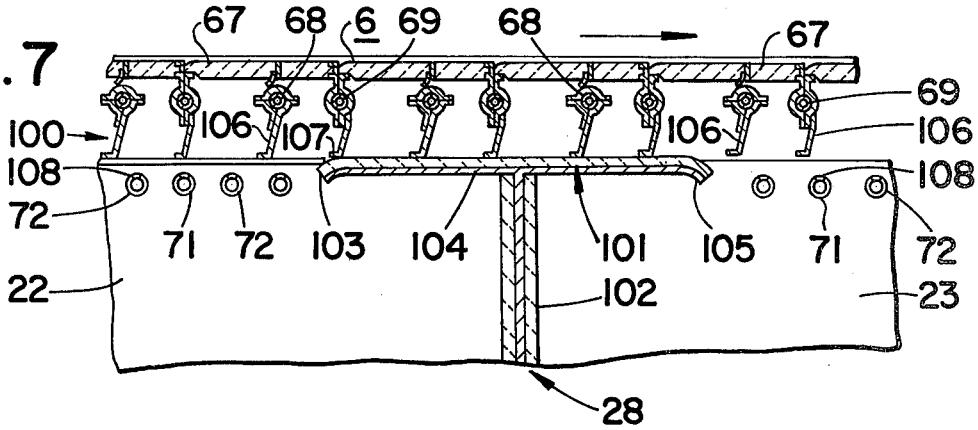
FIG. 7 is a fragmentary cross-sectional elevation showing transverse sealing means that may be used below the grate to form a seal between the moving grate and two zones below the grate.

Transverse sealing means, such as shown in FIG. 7, can be employed at the underside of the moving grate to reduce leakage of gas between the lower gas enclosures of adjacent zones and also from the lower gas enclosures of the endmost treating zones. As shown, sealing means 100 comprises stationary horizontal plate 101 positioned on vertical partition 102 shown as forming part of sealing portion 28 that separates adjacent gas enclosures 22 and 23 of zones A and B. Plate 101 may be made up on an upper portion 103 of wear-resistant metal. Plate 101 extends completely across the width of grate 6 and is fixed gas tight to the sides of the gas enclosure. Front and rear edges 105 of the plate preferably slope downwardly. The grate 6 has a large number of downwardly extending flexible or flexibly mounted sealing vanes 106 below the hearth segments 67 and carried by the support tubes 68 and 69. Each vane carries a flange 107 at its lower edge which slides across the upper surface of plate 101. The vanes 106 are preferably formed of heat-resistant metal and extend across the plate 101 to prevent unwanted gas flow between adjacent zones. Sealing means 100 or other known sealing means can be employed between all of the lower gas enclosures at sealing portions 27 through 32 of FIG. 3.

The stationary horizontal air and gas supply tubes 71 and 72 are mounted at about the same height as the plate 101 so as to be adjacent to but out of the path of movement of the vanes 106. Each tube has a row of regularly spaced discharge openings 108 for directing the air or gas upwardly through the grate 6 to the coke bed.

It will be apparent that the process of this invention can be carried out using apparatus different from that shown in FIG. 3. For example, the desulfurized coke leaving the zone E could be cooled with air to a substantially lower temperature before the coke is removed from the grate.

FIG. 8 is an extended view illustrating schematically another embodiment of the invention in which the hydrocarbon reforming zone D is omitted and replaced with a second cooling zone D′ and the reduction gas required for the desulfurization zone C is supplied through conduit 76*a* from an external gas producer 110. The traveling grate apparatus of FIG. 4 is basically the same as that of FIG. 3 and includes five zones A, B, C, D′, E′ with hoods and lower gas enclosures similar to those of the apparatus 5. The preheat zone A, the heating and calcining zone B, and the desulfurizing zone C are identical to that shown in FIG. 3, and said zones B and C employ the same radiant heating means and the same supply tubes 71 and 72 for air and gas supply. The structure of the two cooling zones D′ and E′ can be substantially the same and similar to that of zone E. As shown the zones have hoods 14*a* and 15*a* similar to hood 15, lower gas enclosures 25*a* and 26*a* similar to enclosure 26, and seal portions 19*a*, 20*a*, 21*a*, 30*a*, 31*a* and 32*a* similar to the seal portions 19, 20, 21, 30, 31 and 32, respectively, of FIG. 3. Cooling water introduced in conduit 55*a* is converted to steam in cooling zone E′ as it moves through the bed to conduit 53*a*, and the steam is superheated as it passes through cooling zone D′ to outlet conduit 109.

The reduction gas supplied through conduit 76*a* to desulfurization zone C (e.g., through tubes 72) may be produced in external gas generation equipment 110 shown schematically in FIG. 4 and having coke beds in vertical vessels 111, 112 and 113.

Air, fuel and steam are supplied to the beds through conduits 114, 115 and 116, respectively, under the control of suitable valves (not shown), whereby one coke bed is heated while a second bed is unloaded and reloaded and a third bed is being supplied with steam to form a producer gas. The steam may come from 89 of zone D′. Branch conduits 117, 118 and 119 for the steam from conduit 116 are opened and closed at different times, and overhead conduits 121, 122 and 123 are opened and closed accordingly. Thus conduit 121 carries reducing gases to conduit 76*a* when conduit 117 carries steam to vessel 111, and conduits 117 and 121 are closed when air and fuel is supplied to vessel 111 during a subsequent heating cycle. During heating of each vessel the flue gases exit to conduit 124.

During the gas generation cycle in each of the vessels 111 to 113, the amount of steam supplied and the reaction conditions will be selected to provide a water gas or reducing gas having the composition needed to effect the desired desulfurization of the moving coke bed in zone C. If desired, methane gas may be introduced with the steam to increase the amount of gas produced.

This invention is suitable for calcination and desulfurization of various coke with sulfur contents up to 10 percent and is particularly intended for treatment of petroleum coke, which is a residue remaining after the complete distillation of oil. The two principal types of petroleum coke are "delayed process coke" and "fluid process coke", and they have sulfur contents from about 2 to 10 percent and more commonly from about 3 to 8 percent.

The green coke can contain from about 4 to 15 percent or more of volatile matter. If coke is to be used for electrode production, it should be calcined to reduce the content of volatile matter to less than 0.5 percent and the moisture content to less than 0.3 percent. The term "complete calcining" refers to reduction in volatile content to 0.5 percent or less, and a "calcining temperature" is a temperature sufficient to effect such reduction.

In normal calcining operation only a small percentage of the sulfur is removed from the coke. A green coke containing slightly more than 1.5 percent sulfur may end up with about 1.3 percent sulfur after calcining. In the electrode industry the trend today is to reject any coke with a sulfur content in excess of 1.2 percent. The present invention provides a remarkably economical process for desulfurizing large amounts of petroleum coke to mass produce electrode-grade coke with a sulfur content of 1 percent by weight or less or to produce a fuel with an acceptable sulfur content, preferably below 2 percent by weight.

It will be apparent that special controls and other equipment may be employed in addition to that described herein. The reaction conditions and temperatures in each zone can be regulated to obtain the desired results. For example, the rate at which the green coke is heated to final calcination temperature can be controlled to avoid possible fragmentation of the coke. If desired, the overhead radiant heaters in zone B can be distributed to provide gradation in heating, and the flow through the tubes 71 and 72 can likewise be controlled, if desired, to achieve a similar result.

An example of the process of this invention is described hereinafter to facilitate an understanding of the invention, but it will be understood that this is merely for purposes of illustration and that the invention can be practiced in different ways using equipment of various types and sizes. For example, the preheat and cooling zones near the inlet and discharge portions of the circular grate apparatus 5 are preferably such that the green coke is preheated to 300° to 500° C. or more before entering the calcining zone and so that the calcined coke is cooled to 200° to 400° C. or less before it is removed from the grate, but such temperatures are not critical.

As one example of the process as applied to manufacture of electrode-grade carbon from petroleum coke, the green coke used could be delayed process coke with a sulfur content of 3 to 8 percent, a volatile content of 4 to 18 percent and a density of about 1.8 grams per cubic centimeter. The coke is preheated in a drier to a temperature of 200° to 250° C. and then ground to a maximum particle size of about 2 millimeters, a major portion by weight having a particle size of 0.4 to 1.5 millimeters. Part of the ground coke is then screened to obtain sized coarse particles with a size in the range of about 1 to 2 millimeters which are used to form upper and lower layers *7a* and *7c* of the coke bed. The finer particles and the coke, as ground, are used to form the main central layer *7b*.

After grinding, the coke particles are fed to the preheater-drier 2, with or without treatment with an activator or catalyst, and may be preheated by the flue gases to a temperature of 150° to 200° C. before being fed to the circular grate apparatus 5. During rotation of the grate the green coke is continuously fed to and distributed on the grate, the aforesaid sized coarse particles (1 mm–2 mm) being applied to form layers *7a* and *7c* with a depth of about 30 centimeters and the unsized ground coke particles and coke fines being applied to form the layer *7b* with a depth of about 1.2 meters so that the overall depth of bed 7 is about 1.8 meters.

In the preheat zone A the green coke is heated to 200° to 250° C., preferably near the point where volatiles begin to leave in appreciable amounts. In the heating and calcining zone B the coke is heated to a calcining temperature sufficient to remove at least 90 percent of the volatile matter and to reduce the volatile content to less than 1 percent, the coke leaving zone B with an average temperature of 800° to 950° C. During calcining the temperature of the radiant heating means 60 above the bed may be 1000° to 1200° C., or higher.

The coke bed 7 is maintained at an average temperature of from about 750° to 900° C. in the desulfurizing zone C, and the reducing gas produced in zone D has a hydrogen content sufficient to reduce the sulfur content of the coke in zone C from more than 3 percent to less than 1 percent by weight. The radiant combustion heating means 70 may have a temperature of 1000° to 1200° C. or higher.

The entire supply of gas and air to zones B and C (conduits 73, 74, 75 and 76) is through tubes 71 and 72 and is controlled to provide the desired temperatures and to maintain an oxygen-deficient atmosphere that avoids combustion of the coke fines.

In the hydrogen reforming zone D, methane gas is introduced from conduit 77 and steam is introduced from conduit 53 at a high temperature, such as 400° to 600° C. The amount of methane and steam is controlled to provide the desired degree of desulfurization in zone C. The coke bed is cooled in the zone D and enters the cooling zone E with an average temperature of from 600° to 800° C. It is further cooled by water in zone E to an average temperature below 400° C. and preferably below 250° C.

In the above example, the green coke is a petroleum coke produced as a by product of a delayed coking process. The ash content of said coke is preferably below 0.5 percent, and the calcined desulfurized product removed from the circular grate after treatment preferably has a relatively suitable for electrode manufacture (e.g., below 0.5 ohm per inch cube).

In carrying out the process, superior results are obtained by controlling the heating during calcining of the coke so that the density of the calcined coke is not substantially greater than 2 grams per cubic centimeter (e.g., 1.95 to 2).

Adequate desulfurization of the coke can be achieved without pretreatment of the green coke with a catalyst or activator solution. Nickel and vanadium in petroleum coke tends to act as hydrogenation and/or cracking catalysts. If the quantity or the form in which these metals are bound is not sufficient to effect the desired level of activity, an activator or catalyst may be added, for example as indicated in FIG. 1. The activator may, for example, be an alkali metal hydroxide or other salt.

The apparatus used to carry out the process may have the zones A to E divided in the proportions indicated In FIGS. 1 and 3 of the drawings, but these may vary considerably. For example, the heating and calcining zone B can extend circumferentially from 70 to 140 degrees and the desulfurizing zone C can extend circumferentially from 50 to 120 degrees. If a reduction gas generation zone D is provided, as in FIG. 3, it can extend circumferentially from 40 to 90 degrees, for example.

The size of the equipment may also vary considerably. For example, the coke bed on the grate may have a width of 3 to 8 meters or more in a traveling grate apparatus of the proportions shown herein.

The temperatures needed to obtain best results when carrying out the calcining and desulfurizing steps will depend on a number of variables such as the type and quality of the coke, the residence times, etc. The type of reducing gas may also vary. Instead of water gas, a coke oven gas could be used or a gas containing substantial amounts (e.g., 20 percent by weight or more) of methane. The water gas or producer gas may also contain small amounts of steam, carbon dioxide and air in addition to the hydrogen and carbon monoxide.

The invention makes it possible to produce large volumes of calcined electrode-grade coke of low sulfur content at much lower cost than could be provided by any methods heretofore proposed.

Heretofore it has been proposed to calcine and desulfurize coke in large retorts using long residence times and high temperatures, such as 1400° to 1700° C., as disclosed, for example, in U.S. Pat. No. 3,954,674. Such temperatures can be used in a stationary refractory lined vessel but would have been considered unacceptable in a circular grate apparatus, particularly because of overheating of the metal parts.

While the invention has been disclosed above with respect to specific embodiments hereof, this is intended for the purpose of illustration rather than limitation and other variations and modifications of the disclosed embodiments will be apparent to those skilled in the art, all within the intended spirit and scope of the invention.

What is claimed is:

1. A process for continuous production of electrode-grade carbon from green coke having a substantial sulfur content, comprising forming a gas-permeable coke bed on a grate, the grate being divided into a series of distinct zones for sequential treatment of the coke of the bed, each zone having an enclosed chamber in which hot gases are passed upwardly or downwardly through the coke bed on said grate, said zones including a preheat zone, a heating and calcining zone, a desulfurizing zone, and a cooling zone; causing relative movement between the coke bed on said grate and said zones while passing gases through the bed in each zone as the bed moves relatively through each zone; the preheated coke bed on said grate being moved relatively through said heating and calcining zone while heated combustion gases move through said coke bed in that zone to heat the bed to a calcining temperature above 600° C.; the hot coke bed on said grate being moved from said heating zone relatively through said desulfurizing and calcining zone while a hydrogen-containing reducing gas is passed through said coke bed in the latter zone and while a temperature of at least 550° C. is maintained in said latter zone to effect desulfurization of the coke under reducing conditions; the desulfurized coke of said bed thereafter being moved relatively through said cooling zone while passing a cooling gas through the bed in that zone to cool the bed; and removing the desulfurized calcinated coke from the grate.

2. The process of claim 1 in which said zones include a separate hydrocarbon reforming zone located between said desulfurizing zone and said cooling zone and in which steam is passed through the hot bed of calcined coke in said reforming zone to form said reducing gas.

3. The process of claim 1 in which at least a portion of the heated flue gases from said heating and calcining zone are recycled downwardly through the bed of green coke in said preheat zone to recover fine particles entrained in the flue gases.

4. The process of claim 1 in which the coke bed has a depth of from about 1 to about 2 meters and a major portion by weight of the coke in the bed has a particle size of from 0.5 to 2 millimeters.

5. The process of claim 3 or claim 4 in which the bed has an upper layer consisting essentially of coarse particles with a particle size no less than 1 millimeter and having a depth of at least 20 centimeters.

6. The process of claim 1 in which a controlled amount of air is introduced into said heating and calcining zone to cause partial combustion of fuel gas in the bed and to provide an oxygen-deficient atmosphere that retards combustion of coke particles.

7. The process of claim 6 in which a radiant combustion heating means is spaced above the bed in said heating and calcining zone and air is supplied to said radiant heating means.

8. The process of claim 6 or claim 7 in which burner means are provided in said preheat zone, the heated flue gases from said heating and calcining zone are returned to said preheat zone, and air is supplied to said burner means to complete combustion of the unburned fuel gases in said flue gases.

9. The process of claim 1, claim 6 or claim 7 in which fuel gas is introduced to said heating and calcining zone along the length of the grate at the bottom of the coke bed to avoid overheating of metal parts of the grate.

10. The process of claim 1 in which the content of volatile matter in the coke of the bed is reduced at least 90 percent as the coke moves through said heating and calcining zone.

11. The process of claim 10 in which the green coke supplied to the grate has a sulfur content of at least 2 percent and the average sulfur content of the coke is reduced in said desulfurization zone to 1 percent or less.

12. The process of claim 11 in which air is introduced into said desulfurizing zone adjacent the bottom of the coke bed to provide partial combustion and an oxygen deficient atmosphere.

13. The process of claim 11 in which radiant combustion heating means is spaced above the bed in said desulfurizing zone and air is supplied to said radiant heating means.

14. The process of claim 11, claim 12 or claim 13 in which said zones include a hydrocarbon reforming zone in which steam and a hydrocarbon gas are passed through the hot bed of calcined coke on the grate to form said reducing gas, said gas containing carbon monoxide and an amount of hydrogen gas such that the average sulfur content of the bed can be reduced in said desulfurizing zone from more than 2 percent to less than 1 percent.

15. A process of producing electrode-grade carbon from green petroleum coke having a sulfur content up to 10 percent by weight comprising forming a gas-permeable coke bed with a depth of from about 1 to about 2 meters on a rotating circular grate, said grate having a charging location where said coke is fed onto said grate and a discharge location where coke is removed from said grate, the portion of the grate between the charging location and the discharge location being divided into a series of separate enclosed zones for sequential treatment of the coke of the bed, each zone having an enclosed chamber in which hot gases are passed through the moving coke bed on said grate and means to limit passage of gases between that zone and adjacent zones along the grate, said zones including a heating and calcining zone and a desulfurizing zone; moving the coke bed on said grate through said heating and calcining zone while passing air and fuel gas to that zone to heat the coke bed and cause its temperature to rise to at least 600° C. and to reduce the content of volatile matter to less than 1 percent by weight; and moving the hot coke bed on said grate from said heating zone through said desulfurizing zone while passing a hydrogen-containing reducing gas through said coke bed in the latter zone and maintaining a temperature of at least 550° C.

16. The process of claim 1 or claim 15 in which said grate is an enclosed circular grate rotating about a vertical axis, said heating and calcining zone extends circumferentially from about 70 to about 140 degrees and said desulfurizing zone extends circumferentially from about 50 to about 120 degrees.

17. The process of claim 16 in which the gases leaving the top of said desulfurizing zone contain unburned gas which is recycled through said heating and calcining zone after cooling and removal of carbon dioxide and hydrogen sulfide.

* * * * *

UNITED STATES PATENT AND TRADEMARK OFFICE

CERTIFICATE OF CORRECTION

PATENT NO. : 4,208,307
DATED : June 17, 1980
INVENTOR(S) : Irvin H. Lutz

It is certified that error appears in the above—identified patent and that said Letters Patent is hereby corrected as shown below:

In column 1, line 48, after "fines by", "combination" should read --combustion--.

In column 6, line 35, after "by passing", "means" should read --some--.

In column 8, line 29, after "made in", "hydrogen" should read --hydrocarbon--.

Signed and Sealed this

*Nineteenth* Day of *August 1980*

[SEAL]

*Attest:*

SIDNEY A. DIAMOND

*Attesting Officer*

*Commissioner of Patents and Trademarks*